United States Patent [19]

Gustavsen

[11] Patent Number: 4,872,231

[45] Date of Patent: Oct. 10, 1989

[54] IMPACT BLADE TOOL

[76] Inventor: Willard Gustavsen, P.O. Box 37, Berrien Springs, Mich. 49103

[21] Appl. No.: 222,688

[22] Filed: Jul. 19, 1988

[51] Int. Cl.[4] ..... B25F 1/00

[52] U.S. Cl. ..... 7/103; 81/488; 30/317

[58] Field of Search ..... 7/103; 294/8.6; 81/488, 81/485; 29/254, 253; 30/317; 254/19

[56] References Cited

U.S. PATENT DOCUMENTS

| | | | |
|---|---|---|---|
| 776,191 | 11/1904 | Lynch | 254/19 |
| 1,521,265 | 12/1924 | Anderson | 29/254 |
| 2,635,337 | 4/1953 | Mercy | 7/103 |
| 3,152,391 | 10/1964 | Bjorn et al. | 29/254 |
| 3,685,064 | 8/1972 | Cuscovitch | 7/103 |
| 3,745,598 | 7/1973 | Krell | 7/103 |
| 4,569,261 | 2/1986 | Morris | 81/488 |

*Primary Examiner*—Roscoe V. Parker
*Attorney, Agent, or Firm*—Dykema Gossett

[57] ABSTRACT

An impact blade tool particularly suitable for tucking carpet and the like into tight corners and beneath baseboards, although the impact blade tool has other application. The impact blade tool includes a handle having substantial mass for driving a blade member including a shank or guide portion telescopically mounted on the handle. A spring resiliently biases the handle away from the blade member and a stop limits telescopic movement of the blade member shank portion away from the handle. The blade member and handle have mating impact driving surfaces such that the handle functions as an impact driver for driving the blade member for tucking carpet or other applications. In the most preferred embodiment, the stop also functions as a blade orienting means releasably retaining the blade in a plurality or oriented positions relative to the handle. The blade portion may be configured similar to a conventional carpet tucking tool or an arcuate carpet knife also used for carpet tucking.

15 Claims, 2 Drawing Sheets

IMPACT BLADE TOOL

FIELD AND BACKGROUND OF THE INVENTION

The present invention relates to impact blade-type tools, particularly spring loaded impact tools including a blade and a handle having substantial mass used as the impacter. The disclosed embodiment is a carpet tucking tool.

In the installation of carpet the carpet must be stretched or tucked over a tack strip adjacent a wall or in a door-way and into tight corners, as found in stairs. This operation is commonly referred to as "carpet tucking" and the tool generally used by commercial installers is referred to as a "stair tool". A stair tool includes a blunt masonry-type chisel and an integral shank portion terminating in a flattened enlarged end which is impacted by a hammer. The stair tool is formed of a tough durable alloy steel to withstand hammering and the blade is ground to a taper to avoid cutting the carpet. Although the tucking chisel or stair tool may be used without a hammer, the tool is generally used by placing the tapered edge of the chisel portion against the carpet to grip the carpet and impacting the free end with a hammer, requiring the use of two hands. The stair tool may also be used in combination with a "knee kicker", which includes a pad at one end and a nap gripper at its opposite end. The nap gripper includes a plurality of angularly extending steel pins which grip the carpet. Thus, particularly in large installations, the commercial installer may be required to operate the knee kicker with one knee and both hands are occupied with the tucking tool.

Carpet or linoleum knives are also used by commercial installers to "tuck" a carpet over the tack strip. A linoleum or carpet knife includes a handle and a flat arcuate blade. The inside edge of the blade is sharpened to the point for cutting and the outside edge may be flat or tapered for tucking. Generally, a linoleum knife is used by a carpet installer to tuck carpet with one hand only, but this method can be hazardous, painful and limiting because, although the other hand is free, it is very tiring and may result in injury to the hand.

Where the stair tool or carpet knife is used in combination with a hammer, the tool or hammer may slip and result in injury to the installer, particularly the installer's hands, or the tool may slip and damage the baseboard. Further, the present methods are time consuming and tiring to the installer. Finally, the repeated impact on a handle of a carpet knife or the impact end of a stair tool may result in damage to the tool, wherein the tool may chip or crack, further exposing the installer to potential injury.

As will now be understood, there is a need for a carpet tucking tool which avoids the disadvantages and dangers of the present tools, preferably a tool which may be used with one hand and which reduces or eliminates the danger of injury to the installer. Further, the tucking tool should require less energy, yet be faster in operation while reducing the likelihood of damage to baseboards. The embodiments of the carpet tucking tools of this invention achieve these advantages and the impact blade tool of this invention may also be used for other applications.

SUMMARY OF THE INVENTION

The impact blade tool of this invention is particularly, although not exclusively suitable for tucking a carpet or the like into a tight corner, such as the inside corner of a staircase, or beneath the baseboard, eliminating the requirement for a separate hammer and providing more accurate location of the carpet gripping blade portion, thereby reducing damage to baseboards and injury to the carpet installer. The carpet tucking tool of this invention is rugged, yet simple in construction and operation. The impact blade tool of this invention includes a blade member having a guide portion at one end and a blade portion adjacent its opposite end. The handle has substantial mass for driving the blade portion and includes a guide portion telescopically mounted on the blade member guide portion. In the disclosed and preferred embodiments, the handle includes a guide bore and the blade includes an integral shank portion telescopically received in the handle guide bore. Spring means, such as a coil spring, preferably located within the handle guide bore, resiliently biases the handle away from the blade member and the assembly includes a stop, limiting relative telescopic movement of the guide portions of the handle and blade member, retaining the blade member shank portion in the handle bore. The blade member and handle have mating impact driving surfaces, such that the handle functions as an impact driver, driving the blade member upon impact of the mating impact driving surfaces of the relatively massive handle and the blade member.

In operation for tucking carpet, the carpet gripping edge of the blade member is engaged against the carpet near the corner or baseboard and the handle is driven to engage mating impact driving surfaces, driving the carpet into the desired position. The blade member may therefore be accurately located for optimum use, and the requirement for a separate hammer is eliminated, permitting operation with one hand.

In one preferred embodiment of the invention, the gripping portion of the handle is generally cylindrical and the guide bore is provided by a guide tube extending generally perpendicular to the axis of the cylindrical handle. The blade member may be chisel-shaped, similar to a conventional carpet tucking tool and preferably includes a generally cylindrical shank portion which is telescopically received in the guide tube of the handle. In a most preferred form of this embodiment, the shank portion of the blade member includes a plurality of flats, such as a polygonal surface, and the blade portion may be oriented in a plurality of rotationally oriented positions by a rod-like member fixed relative to the handle and resiliently biased against one of the polygonal surfaces. In a most preferred form of this embodiment, the rod-like element is arcuate, fixed relative to the handle and extends through an opening in the guide tube to engage one of the polygonal surfaces of the blade shank. The rod-like element also functions as the stop. The spring means is a coil spring received within the guide tube and surrounding the free end of the blade member shank portion, resiliently biased against a flange portion on the shank portion to telescopically bias the shank portion out of the handle guide tube. In another embodiment, the shank portion of the blade member includes a polymeric split tube or bushing and the rod-like element is resiliently biased into the split to releasably retain the blade portion in any desired rotational orientation.

In another embodiment of this invention, the blade member is flat having an arcuate blade portion, similar to a conventional carpet knife, having a sharp cutting edge along the inner periphery of the arcuate end and a blunt tucking surface along the outer periphery of the arcuate end. In this embodiment, the handle is generally cylindrical having an axial bore which telescopically receives the integral shank portion of the flat blade member. In this embodiment, the shank portion of the blade member includes flanges which engage a cap-closure threadably received in the open end of the handle bore, limiting telescopic movement of the shank portion in the handle bore and retaining the handle on the blade member shank portion. This tool thus functions as an improved carpet tucking tool, wherein the blunted outer edge of the arcuate blade may be used to tuck the carpet upon impact by the handle, as described above, and a carpet cutting knife, wherein the sharp inner edge of the blade is used to cut the carpet.

Thus, it will be understood that the carpet cutting tool of this invention allows for more rapid installation of carpets in tight corners and the like because the spring means rapidly returns the weighted handle to a position for impact while holding the face of the carpet tucking edge against the carpet. It will also be understood that the impact blade tool of this invention may be used for other applications requiring a tool having a blade portion and wherein the blade must be driven against or across a surface, such as encountered in the removal of wallpaper, stripping and the like. The shank portion may also include a socket for use of alternative tools. Finally, the impact tool of this invention is safer to use than other impact blade tools requiring hammer blows on the free end of the shank portion, wherein the operator's hands may be injured by the hammer blow or the shank portion may splinter causing injury to the operator.

Other advantages and meritorious features of the impact blade tool and carpet tucking tool of this invention will be more fully understood from the following description of the preferred embodiments, the appended claims and the drawings, a brief description of which follows.

DETAILED DESCRIPTION OF THE PREFERRED EMBODIMENTS OF THE INVENTION

Figure 1:
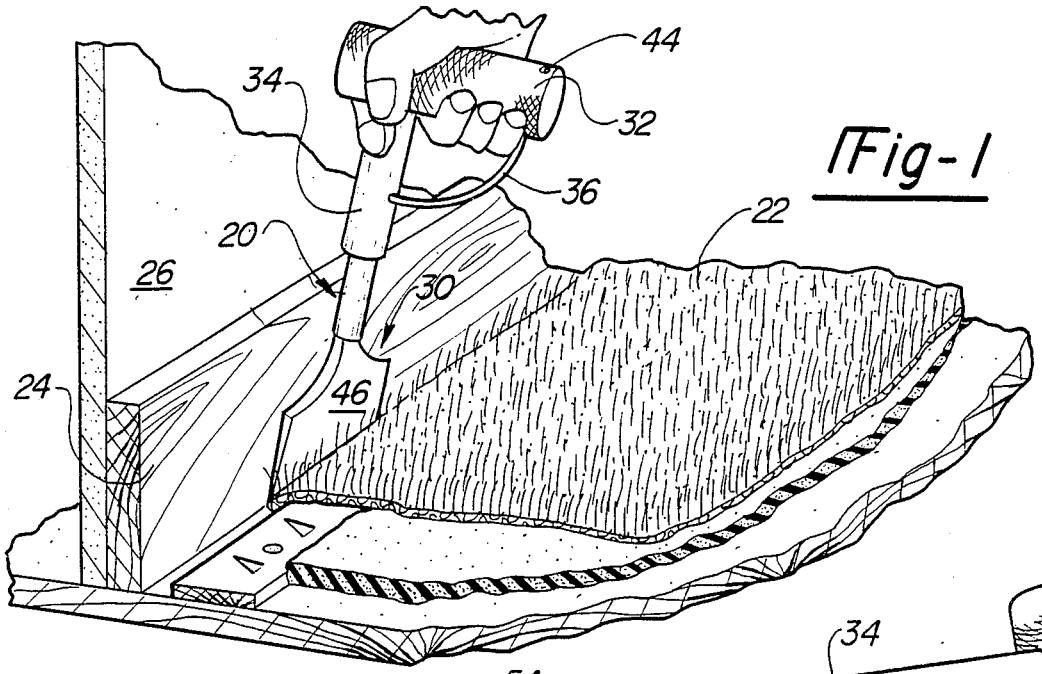
FIG. 1 illustrates the use of one embodiment of the carpet tucking tool of this invention to tuck carpet beneath a conventional baseboard.
Figure 2:
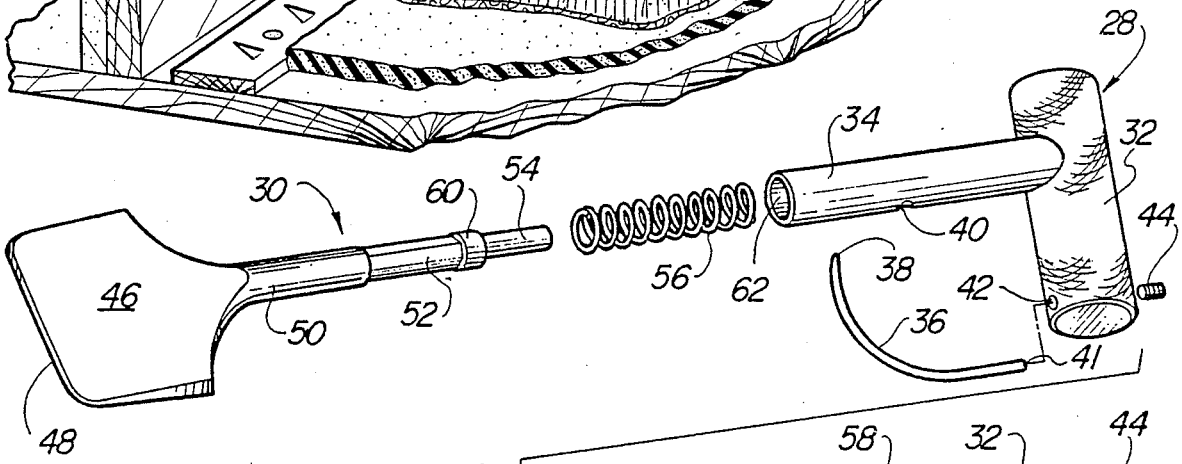
FIG. 2 is an exploded side elevation of the carpet tucking tool shown in FIG. 1.

FIG. 1 illustrates one preferred embodiment of the carpet tucking tool 20 of this invention used to tuck carpet 22 beneath a baseboard 24 of a wall 26. The carpet tucking tool 20 includes a handle or handle assembly 28 and a blade member 30. As best shown in FIG. 2, the handle assembly 28 includes a generally cylindrical grip member 32 which may be externally knurled for better gripping as shown in FIG. 1. The handle assembly 28 further includes a guide tube or guide portion 34 and a stop, antirotation element 36 having a rounded end 38 received through an aperture 40 in guide tube 34 and an opposite end 41 received through a bore 42 in the cylindrical grip member 32 (see FIGS. 3 and 4). A set screw 44 is threadably received in the opposite end of bore 42 to bias the stop and gripping element 36 into bore 40, as described hereinbelow.

The blade member 30 in the disclosed embodiment includes a masonry-type chisel blade 46 having a tapered carpet gripping edge 48 and an integral shank portion 50. The shank portion includes a hexagonal mid-portion 52 and a reduced diameter end portion 54.

Figure 3:
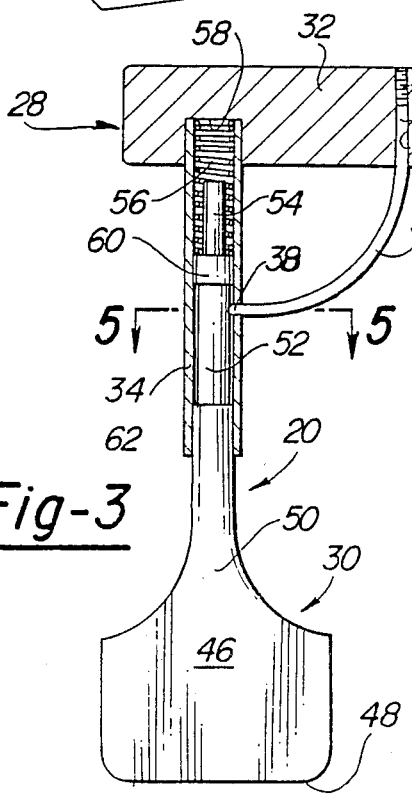
FIG. 3 is a partially cross-sectional side view of the carpet tucking tool shown in FIGS. 1 and 2.

As best shown in FIG. 3, the tubular guide portion 34 is received and secured in bore 58 extending partially through the gripping member 32 of the handle 28. The tubular guide portion 34 telescopically receives the shank portion 50 of the blade member 30. In the disclosed embodiment, the shank portion 50 is generally cylindrical and includes an upper cylindrical portion 60 which guides the shank portion as the shank portion is telescopically moved into and out of the guide tube 34. The external diameter of the cylindrical shank 50, including the upper guide portion 60, is preferably approximately the same as the internal diameter of the opening 62 through the guide tube 34, such that the shank is fully supported in telescopic movement in the tube 34. The bore 58 in the grip member 32 has a flat bottom wall, as shown in FIGS. 3 and 4, and the end 60 of the shank is also flat, providing mating impact surfaces on the shank and the handle for driving the blade member 30, as described below.

In the preferred embodiment of the invention, the handle 28 has substantial mass for driving the blade during carpet tucking operations. In this disclosed embodiment of FIGS. 1 through 5, the handle 28 is pistol-shaped, wherein the grip member 32 may be formed of solid steel or the like, providing the mass for driving the blade member. The unique stop and anti-rotation element 36 serves as both a stop means and a releasable anti-rotation means. As best shown in FIGS. 3 and 4, the rod-shaped stop and anti-rotation element 36 is arcuate or semi-circular, wherein the rounded end 38 is resiliently biased against the hexagonal surface portion 52 of the shank portion 50 preventing the shank portion from coming out of the tubular guide portion 34. The coil spring 56 is resiliently biased against the bottom of bore 58 and the cylindrical guide portion 60, urging the shank portion 50 out of the guide tube. The rounded end 38 engages the guide portion 60 limiting telescopic movement of the shank portion 50 in the guide tube and retaining the handle 28 on the blade member 30.

Figure 5:
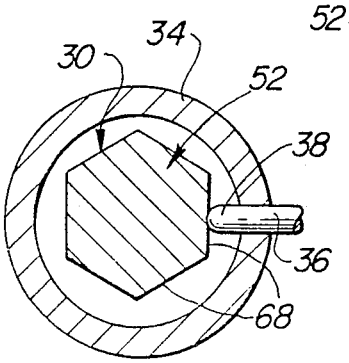
FIG. 5 is an end cross-sectional view of the carpet tucking tool shown in FIG. 3 in the direction of view arrows 5—5.

As best shown in FIG. 5, the arcuate rod-like element 36 also releasably retains the blade member 30 in one of a plurality of rotation positions. The rounded end 38 of the stop and anti-rotation element 36 is resiliently biased against one of the flat surfaces 68 of the hexagonal portion 52. When sufficient rotational force is applied to the blade or shank portions 46 and 50, respectively, the blade may be turned or rotated relative to the handle 28, permitting the operator to change the position of the blade portion 46 relative to the grip member 32. This is an important advantage of the embodiment of the carpet tucking tool 20 of this invention. Thus, the operator may turn the blade 46 relative to the handle 28 for maximum utilization of the tool from various stationary positions of the body of the carpet installer. The set screw 44 may be threadably extended or retracted to allow for different paces and needs in the process of installing a carpet, or in the process of using slightly different chisel configurations requiring different tension, depending on the density of the material being tucked and the strength and desires of the installer. This makes the use of the tool less tiring and permits the tool to be used against different surfaces.

Figure 4:
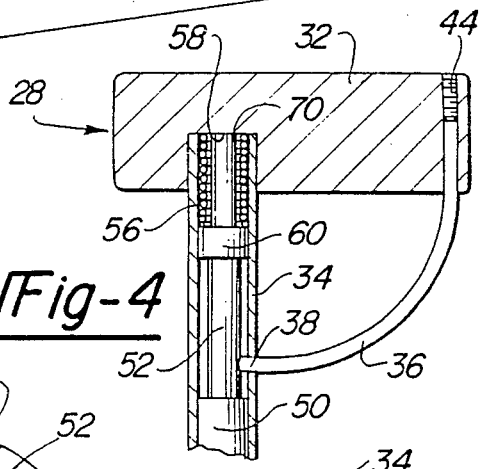
FIG. 4 is a partial side cross-sectional view of the embodiment of the carpet tucking tool shown in FIGS. 1 through 3 illustrating the tool at the moment of impact.

Having described the elements of the carpet tucking tool 20 of Figures 1 through 5, it is now possible to describe its operation and use, as shown in FIG. 1. The knurled grip member 32 of the handle 28 may be gripped by either the right or left hand of the installer, with the index finger over the tubular guide 34 in a pistol grip. The tapered carpet gripping edge 48 (see FIG. 2) is then placed against the carpet in the desired position near the tack strip (not shown). The installer's arm is then extended rapidly, compressing spring 56 and telescoping the shank portion 50 of the blade member until the flat end 70 of the shank portion impacts the bottom of the bore 58 in the grip member 32, as shown in FIG. 4. As described, the grip member 32 has substantial mass and the impact force is then transmitted through shank portion 50 to the carpet gripping edge 48 of the blade, tucking the carpet beneath the baseboard 24, over the tack strip and securing the carpet in the desired position. The impact force of the mating impact surfaces, 58 and 70, also forces the handle 28 away from the blade portion 46, and the coil spring 56 completes the relative movement of the handle 28 as the installer relaxes the pressure. The blade may then be rapidly moved to the next position and the process repeated again and again in rapid succession. The blade 46 is retained in the "set" position by the anti-rotation element 36 which engages the hexagonal surface 52 of the shank portion 50 under the force set by set screw 44. The set screw preferably has an allen wrench socket, such that the force may be adjusted, as described. When the installer desires to turn the blade 46 relative to the handle 28, the handle may be set in any one of six positions by rotating the handle under sufficient force to bias the end 38 of the anti-rotation element 36 to one of the other flat surfaces 68, as shown in FIG. 5. The arcuate or semi-circular configuration of the anti-rotation and stop 36, which in the disclosed embodiment is a spring steel rod, spring biases the arcuate end 38 against the hexagonal portion 52 of the shank 50.

The embodiment of the carpet tucking tool 20 shown in FIGS. 1 through 5 is thus simple in operation, yet rugged in construction. The blade member 30 may be drop forged from chisel steel in a single piece. The blade portion 46 may be chrome plated to reduce carpet damage. As described, the gripping element 32 may be formed from a solid steel cylinder, which is preferably externally knurled to provide a better gripping surface. The guide tube 34 may be formed of steel and press fit into bore 58, forming a pistol grip, as described. Thus, the rugged construction of the carpet tucking tool provides years of wear, while reducing the likelihood of injury and permitting easy operation with one hand.

Figure 6:
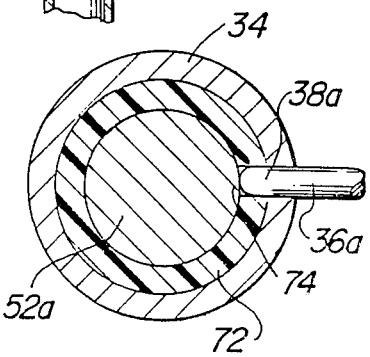
FIG. 6 is an end cross-sectional view, similar to FIG. 5, of an alternative embodiment of the carpet tucking tool of this invention.

FIG. 6 illustrates an alternative embodiment of the stop and anti-rotation means for the tucking tool 20, wherein a columnar split bushing 72, preferably formed of an anti-friction polymeric material, such as nylon, is substituted for the hexagonal surface portion 52. The spring biased end **38*a* of the stop and anti-rotation element 36*a* is pointed or conical and received in the split 74 in the bushing. The conical end 38*a* spreads the split bushing 72, expanding the bushing and providing sufficient force to retain the blade portion 46 (FIG. 2) in the desired position during operation. An anti-friction polymeric material, such as nylon, is preferred, so that the blade portion 46 may be turned, as desired, and the conical end 38*a* will remain in the split 74, permitting telescopic movement of the shank portion 50 in the guide tube 34. In this embodiment, a separate stop means, such as a conventional set screw (not shown) may be used or the element 36*a* may also function as a stop means by providing an enlarged guide portion 60**, as described above.

Figure 7:
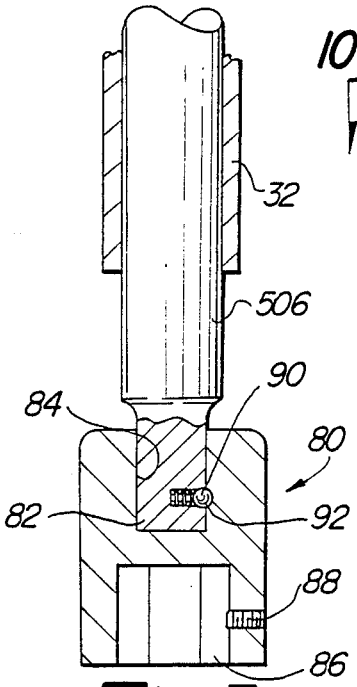
FIG. 7 is a partially cross-sectional side view of an end portion of a socket-type impact tool, permitting the use of alternative blade-type tools.
Figure 8:
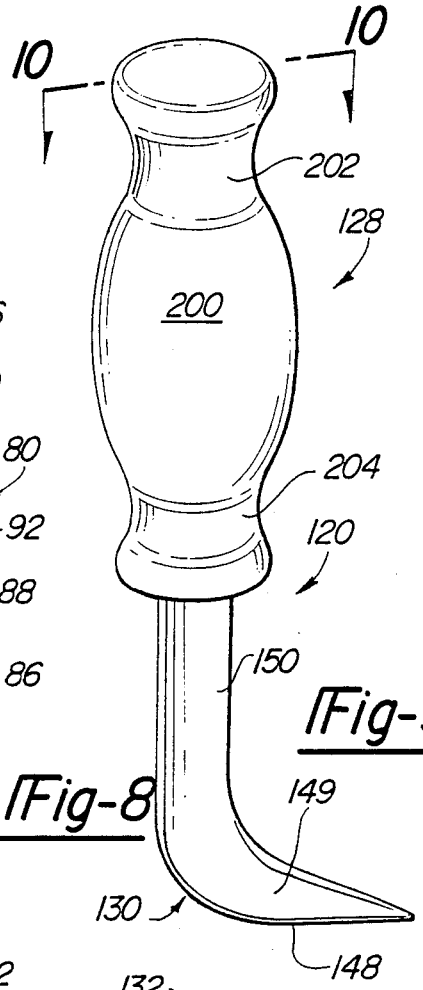
FIG. 8 is a side elevation of a further embodiment of the carpet tucking tool of this invention utilizing a carpet or linoleum knife.

FIG. 7 illustrates a modification of the impact tool shown in FIGS. 1 through 5, wherein the shank portion **50*b* includes a socket 80 for utilization of other work engaging tools, such as alternative blade configurations, including curved blades, sharpened blades, etc. The disclosed embodiment of FIG. 7 includes a reduced portion 82 at the free-end of the shank portion 50*b* which is received in an axial bore 84 in the socket member 80. The socket member also includes a polygonal bore or opening 86 for receipt of the shank portion of a tool and a set screw 88 is provided to retain the tool in the socket 86. The disclosed embodiment in FIG. 7 also includes a spring biased ball 90 to retain the socket 80 in desired rotational positions, wherein the bore 80 includes a plurality of spherical indents 92 which receive the spring biased ball 90 for orientation of the socket 80 and the attached tool, not shown. All other elements of the impact tool may be identical to the tool described in regard to FIGS. 1 through 5**.

FIGS. 8 through 11 illustrate an alternative embodiment of the impact blade tool 120 of this invention, wherein the blade member is flat and arcuate, similar to a linoleum or carpet knife, and the handle 128 is oriented generally axially relative to the blade member 130. As will be noted, the numbering sequence used in describing the embodiment 120 of the carpet tucking tool shown in FIGS. 8 through 11 is similar to the sequence used above in describing the carpet tucking tool embodiment 20 for ease of understanding.

The handle grip member 132 includes a generally axially guide bore 162 which telescopically receives coil spring 156 and the shank portion 150 of the blade member 130. The blade portion 146 in this embodiment is arcuate, including an outer tucking edge 148 for tucking carpet, as described above, and inner-cutting edge 149, which extends to the tip, for cutting carpet and linoleum.

A cylindrical impact member 160 is secured on the end of the shank portion 150 of the blade member. The impact member 160 includes a slot 161 which receives the free-end of the shank portion and a retainer pin 94 is received through openings 196 and 198 in the impact member 160 and shank 150, respectively, to retain the impact member on the free-end of the shank portion 150. The shank portion includes a flat impact surface 170 which impacts against the flat bottom wall of guide bore 162 to drive the blade member 130, as described above.

Figure 9:
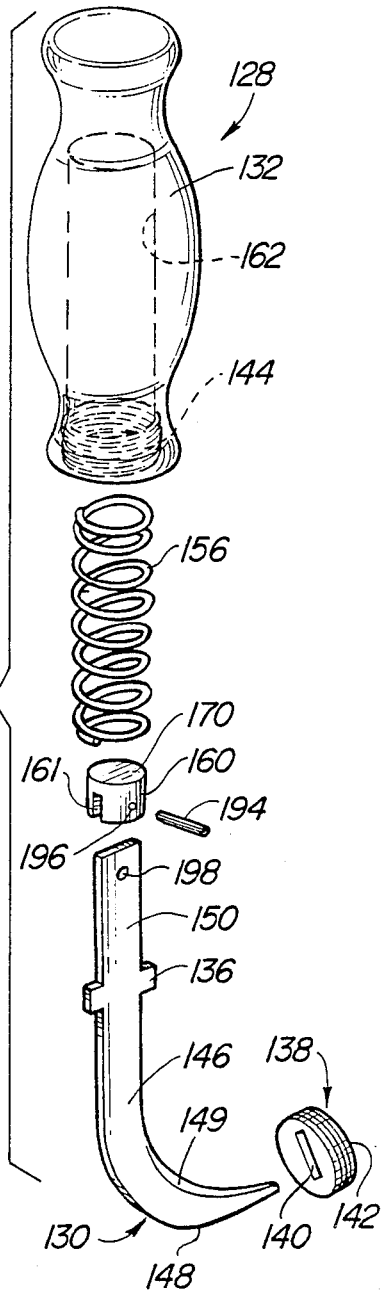
FIG. 9 is an exploded side elevation of the carpet tucking tool shown in FIG. 8.
Figure 10:
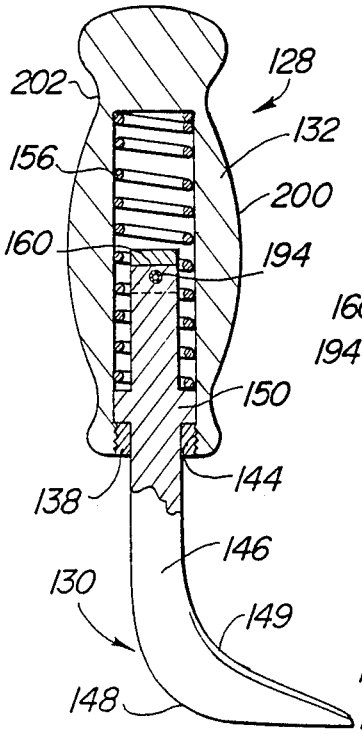
FIG. 10 is a partially cross-sectional side view of the carpet tucking tool shown in FIG. 8 in the direction of view arrows 10—10.
Figure 11:
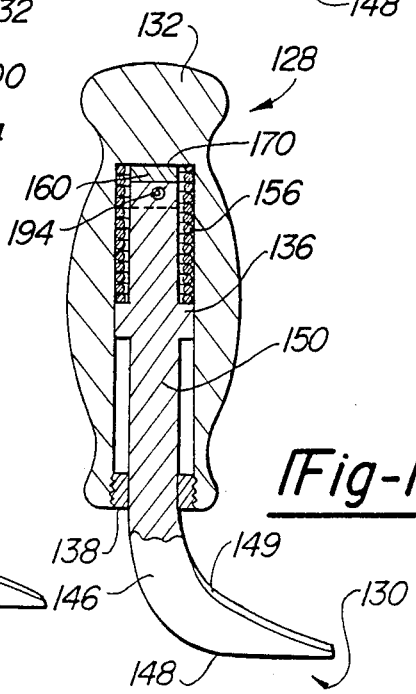
FIG. 11 is a partially cross-sectional side elevation of the carpet tucking tool shown in FIGS. 8 through 10 with the handle impacting the blade during carpet tucking.

The stop means which retains the handle element 132 on the blade member 130 in this embodiment comprises flange portions 136 on the blade shank 150 and threaded closure element 138. As shown in FIG. 9, closure element 138 includes a slot 140 which receives the flat shank portion 150 beneath flanges 136 and the closure member is externally threaded at 142 to be threadably received in the internally threaded opening 144 to guide bore 162. As best shown in FIGS. 10 and 11, the closure 138 retains the handle member 132 on the shank portion 150 of the blade member 130. The blade member may be removed by threadably removing the closure member 138.

Having described the elements of the embodiment of the impact blade tool 120 shown in FIGS. 8 through 11, the operation and use may now be described. The tucking outer surface 148 of the blade portion 146 is disposed against the carpet as described in regards to the operation of the carpet tucking tool 20 of FIG. 1. The handle 128 is then pushed forcibly toward the blade, compressing spring 156 until the impact surface 170 engages the mating impact surface at the bottom of bore 162, as shown in FIG. 11. As described, the handle element 132 has substantial mass, driving the carpet tucking edge 148 forwardly, away from the handle, urging the carpet to the desired position as described above. As the pressure on the handle by the installer is released, the coil spring 156 further urges the handle member 132 rearwardly until the stop flanges 136 engage the closure element 138, as shown in FIG. 10. The impact blade tool 120 is then ready for rapid repeated operations, as described. Further, the sharp cutting edge 149 may be used to cut carpet or linoleum, providing a multi-use tool. The blade member 130 may be formed from tool steel, similar to a conventional carpet cutting knife and the impact handle member 132 may be formed of steel, providing sufficient mass for the impact blade tool of this invention. As will be understood, the shape of the handle member 132 is similar to the shape of a conventional carpet knife, including an enlarged gripping mid-portion and reduced concave portions 202 and 204, providing an excellent grip for the impact tool. The embodiment of the impact blade tool of FIGS. 8 through 11 does not include an anti-rotation means; however, an anti-rotation means may be provided, if desired.

Having described the preferred embodiments of the impact blade tools of this invention and the use or operation of such tools, it will be understood that various modifications may be made to such embodiments within the purview of the appended claims. For example, the shank portion 150 of the carpet tucking tool and knife 120 disclosed in FIGS. 8 through 11 may be drop forged and includes a cylindrical shank, wherein the blade may be turned and an anti-rotation means utilized as disclosed in the embodiment of the tucker tool shown in FIGS. 1 through 5. Further, as described above, separate anti-rotation and stop means may be utilized in the embodiment of the carpet tucking tool shown in FIGS. 1 through 5. The configuration of the blades will depend upon the particular application for the carpet tucking tool and other blade configurations may be used for other applications of the impact blade tool of this invention. Finally, the preferred materials for the impact blade tools and carpet tucking tools of this invention will also depend upon the application of the tool and the disclosures regarding materials herein are not intended to limit the use of other materials.

I claim:

1. A carpet tucking tool, comprising:

(a) a blade member having a guide portion at one end and a carpet gripping edge adjacent its opposite end;

(b) a handle having substantial mass including a guide portion telescopically mounted on said blade member guide portion;

(c) spring means resiliently biasing said handle guide portion telescopically away from said blade member guide portion;

(d) stop means limiting relative telescopic movement of said guide portions of said handle and blade member, retaining said handle guide portion on said blade member guide portion;

(e) said blade member and handle having mating impact driving surfaces whereby said handle functions as an impact driver driving said gripping edge upon impact of said driving surfaces; and (f) means preventing relative rotation of said handle and said blade during telescopic movement thereof; and said handle includes a generally cylindrical transverse solid gripping portion, said means preventing relative rotation being fixed to said gripping portion for selective engagement with said blade guide portion.

2. The carpet tucking tool defined in claim 1, characterized in that said blade member opposite end comprises an arcuate carpet knife having a sharp cutting edge along its inner arcuate edge and a blunted carpet gripping edge along its outer arcuate edge, said blade member one end comprising a shank portion integral with said arcuate carpet knife and said handle having a bore telescopically receiving said blade member shank portion.

3. The carpet cutting tool defined in claim 1, characterized in that said handle guide portion is tubular, rotatably supporting said blade member guide portion, and said carpet tucking tool including orienting means releasably retaining said blade member in predetermined rotational oriented positions for adjusting the orientation of said carpet gripping edge relative to said handle.

4. The carpet tucking tool defined in claim 3, characterized in that said blade member guide portion comprises a shank integral with said carpet gripping edge telescopically received in said handle tubular guide portion, and said shank including a portion having at least two generally flat surfaces, said orienting means including a retainer element spring biased against one of said shank portion flat surfaces releasably retaining said shank portion in one of at least two rotatably oriented positions.

5. The carpet tucking tool defined in claim 4, characterized in that said handle is generally cylindrical having an axis generally perpendicular to said tubular guide portion.

6. The carpet tucking tool defined in claim 5, characterized in that said shank portion is polygonal and said orienting means comprises a rod fixed relative to said handle resiliently biased against one of said polygonal surfaces of said blade member shank portion releasably retaining said handle in one of a plurality of rotational positions.

7. An impact blade tool comprising:

(a) a handle having substantial mass including a guide bore;

(b) a blade member including a blade portion adjacent one end and a shank portion at its opposite end telescopically received in said handle guide bore;

(c) spring means located within said handle guide bore telescopically biasing said handle away from said blade member;

(d) stop means limiting relative telescopic movement of said blade member shank portion in said handle guide bore and retaining said blade member shank portion in said guide bore;

(e) mating impacting driving surfaces on said blade member shank portion and said handle whereby said handle functions as an impact driver for driving said blade portion upon impact of said mating driving surfaces; and (f) said blade member shank portion and said handle bore are generally cylindrical and said shank portion rotatably supported in said handle bore, and said impact blade tool including orienting means releasably retaining said blade member shank portion in predetermined rotational oriented positions relative to said handle.

8. The impact blade tool defined in claim 7, characterized in that said handle including a generally cylindrical solid gripping portion and a generally transverse tubular portion having an internal bore defining said guide bore and telescopically receiving said blade member shank portion.

9. The impact blade tool defined in claim 8, characterized in that said blade member shank portion includes a polygonal surface and said orienting means include a rod-like element fixed relative to said handle and resiliently biased against one of said polygonal surfaces releasably retaining said blade member shank portion in one of a plurality of rotational oriented positions.

10. The impact blade tool defined in claim 7, characterized in that said blade member is generally flat including an arcuate blade portion and an integral shank portion and said blade portion including a sharp cutting edge.

11. A carpet tucking tool, comprising:

(a) a handle having substantial mass including a guide bore;

(b) a blade member having a blade portion adjacent one end and a shank portion at its opposite end telescopically received in said handle guide bore and said handle guide bore being generally cylindrical permitting rotational movement of said blade member shank portion relative to said handle;

(c) spring means located within said handle guide bore resiliently biasing said blade member shank portion out of said handle guide bore;

(d) stop means limiting telescopic movement of said blade member shank portion in said handle guide bore, retaining said shank portion in said handle guide bore;

(e) mating impact drive surfaces on said blade member shank portion and said handle, whereby said handle functions as an impact driver for said blade member blade portion; and (f) orienting means releasably retaining said blade member shank portion in predetermined rotational oriented positions within said handle guide bore for adjusting the rotational orientation of said blade member relative to said handle.

12. The carpet tucking tool defined in claim 11 characterized in that said handle includes a generally cylindrical solid gripping portion and a generally transverse tubular guide portion having an internal bore defining said guide bore and telescopically receiving said blade member shank portion.

13. The carpet tucking tool defined in claim 12, characterized in that said blade member shank portion includes a polygonal surface and said orienting means includes a rod-like element fixed relative to said handle and resiliently biased against one of said polygonal surfaces of said shank portion releasably retaining said blade member shank portion in one of a plurality of rotationally oriented positions.

14. A carpet tucking tool, comprising:

(a) a generally cylindrical handle having substantial mass including a generally axially oriented guide bore;

(b) a generally flat blade member including an arcuate blade portion at one end an integral shank portion telescopically received in said handle guide bore;

(c) spring means located within said handle guide bore resiliently and telescopically biasing said blade member shank portion out of said handle guide bore;

(d) stop means limiting telescopic movement of said blade member shank portion in said handle guide bore, retaining said shank portion in said handle guide bore;

(e) mating impact driving surfaces on said blade member shank portion and said handle, whereby said handle functions as an impact driver driving said blade member arcuate blade portion upon impact of said mating impact driving surfaces; and (f) said arcuate blade portion includes a sharp cutting edge on the inner edge of said arcuate blade portion and a blunt carpet gripping edge at the outer periphery of said arcuate blade portion.

15. The carpet tucking tool defined in claim 14, wherein said generally flat blade member shank portion includes transverse flanges telescopically received in said handle guide bore and said stop means includes a stop member fixed relative to said handle engaging said transverse flanges and limited telescopic movement of said shank portion in said handle guide bore.

* * * * *